US009358607B2

(12) United States Patent
Ishida et al.

(10) Patent No.: US 9,358,607 B2
(45) Date of Patent: Jun. 7, 2016

(54) METHOD FOR MANUFACTURING BORON-CONTAINING ALUMINUM PLATE MATERIAL

(71) Applicant: (Kobe Steel, Ltd.), Kobe-shi (JP)

(72) Inventors: Hitoshi Ishida, Kobe (JP); Ryutaro Wada, Shinagawa-ku (JP); Yukinobu Natsume, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/399,404

(22) PCT Filed: May 13, 2013

(86) PCT No.: PCT/JP2013/063306

§ 371 (c)(1),
(2) Date: Nov. 6, 2014

(87) PCT Pub. No.: WO2013/175988

PCT Pub. Date: Nov. 28, 2013

(65) Prior Publication Data

US 2015/0151360 A1 Jun. 4, 2015

(30) Foreign Application Priority Data

May 24, 2012 (JP) ..... 2012-118567
Jan. 23, 2013 (JP) ..... 2013-010054

(51) Int. Cl.
*B22D 19/14* (2006.01)
*B22D 19/00* (2006.01)
(Continued)

(52) U.S. Cl.
CPC ..... *B22D 19/14* (2013.01); *B22D 19/00* (2013.01); *B22D 19/04* (2013.01); *B22D 31/00* (2013.01); *C22C 21/00* (2013.01); *C22C 21/02* (2013.01);
(Continued)

(58) Field of Classification Search
CPC ..... B22D 19/04; B22D 19/14; B22D 19/00; B22D 31/00
See application file for complete search history.

(56) References Cited

U.S. PATENT DOCUMENTS

2007/0064860 A1 3/2007 Kusui et al.

FOREIGN PATENT DOCUMENTS

JP 11 10310 1/1999
JP 3207840 7/2001
(Continued)

OTHER PUBLICATIONS

International Search Report and Written Opinion of the International Searching Authority Issued Jun. 11, 2013 in PCT/JP13/063306 Filed May 13, 2013.

*Primary Examiner* — Kevin P Kerns
*Assistant Examiner* — Steven Ha
(74) *Attorney, Agent, or Firm* — Oblon, McClelland, Maier & Neustadt, L.L.P.

(57) ABSTRACT

A method for manufacturing a boron-containing aluminum plate material comprises: a spreading step for spreading boron-containing alloy particles (3) in the shape of a layer over a bottom plate (2) placed in a container (1); a preheating step for preheating both the container (1) and a tundish (6) mounted on the container (1); a casting step for enveloped-casting the layer of the boron-containing alloy particles (3) in the container (1) with molten aluminum (10) by pouring the molten aluminum (10) into the tundish (6) to manufacture an enveloped-cast plate (14) with a predetermined thickness; and a cutting step for cutting off shrinkage cavities (13) occurring in a feeder section (12) of the upper portion of the enveloped-cast plate (14).

13 Claims, 1 Drawing Sheet

(51) Int. Cl.

| | |
|---|---|
| ***G21F 9/36*** | (2006.01) |
| ***B22D 19/04*** | (2006.01) |
| ***C22C 21/02*** | (2006.01) |
| ***G21F 1/08*** | (2006.01) |
| ***G21F 5/005*** | (2006.01) |
| ***C22C 21/00*** | (2006.01) |
| ***B22D 31/00*** | (2006.01) |

(52) U.S. Cl.
CPC *G21F 1/08* (2013.01); *G21F 5/005* (2013.01); *G21F 9/36* (2013.01)

(56) References Cited

FOREIGN PATENT DOCUMENTS

| | | |
|---|---|---|
| JP | 2003 121590 | 4/2003 |
| WO | 2004 102586 | 11/2004 |

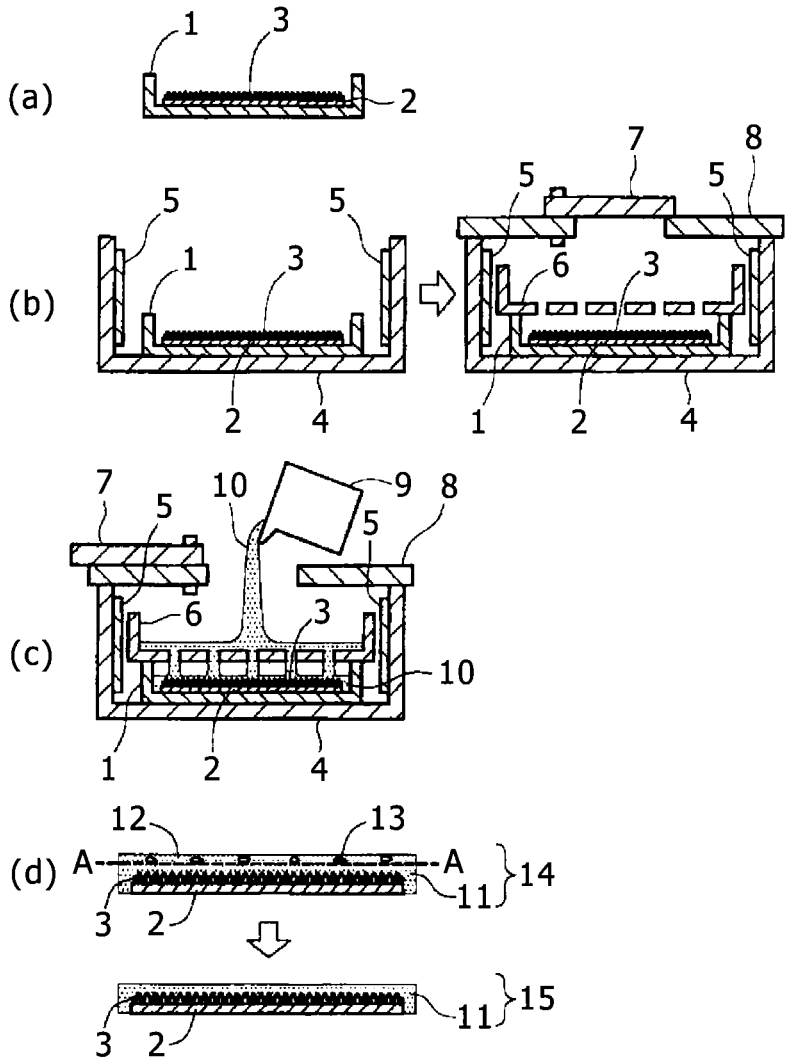
(a)
1
3
2
(b)
5
5
1
3
2
4
7
8
5
5
6
3
1
2
4
(c)
7
5
10
9
8
5
6
3
10
1
2
4
(d)
12
13
A
A
14
3
2
11
15
3
2
11

METHOD FOR MANUFACTURING BORON-CONTAINING ALUMINUM PLATE MATERIAL

TECHNICAL FIELD

The present invention relates to a method for manufacturing a boron-containing aluminum plate material. Hereinafter, boron may be referred to as "B".

BACKGROUND ART

Recently, there is an increased demand for interim storage of spent fuel (hereinafter, referred to as "SF") in a nuclear power plant. Furthermore, in a recent trend, the interim storage of SF is shifted from wet storage (storage in water) to dry storage (storage with air cooling). Consequently, SF shows a higher calorific value and higher neutron formation density than in the past. Hence, a boron-containing aluminum plate material for forming a cask or a canister as a SF storage container is also required to have higher boron content than in the past.

A melting-and-casting process has been used for manufacturing boron-containing aluminum alloy. The melting-and-casting process includes a process in which powdery boron is mixed in aluminum alloy metal that is then melted and casted (hereinafter, referred to "former melting-and-casting process"), and a process in which a boron fluoride such as KBF4 and a catalyst are mixed into molten aluminum to produce an aluminum-boron intermediate alloy that is then casted while boron concentration is adjusted (hereinafter, referred to "latter melting-and-casting process"). The ingot casted in this way is formed into a plate material through rolling or extruding.

In the former melting-and-casting process, various boron compounds are formed in the aluminum-boron alloy through crystallization and precipitation, leading to degradation in workability. Furthermore, the formed various boron compounds each settle out or surface depending on their specific gravities different from one another, resulting in nonuniform boron distribution (i.e., segregation). As a result, there occurs a portion having a low boron concentration with respect to the amount of added boron, so that actually achievable boron concentration has an upper limit of about 1 mass %.

The latter melting-and-casting process inevitably requires boron (enriched boron) having an increased concentration of boron isotope with a mass number of 10 (hereinafter, referred to "B-10") which has thermal neutron absorbing power. Such enriched boron, however, is extremely expensive, leading to a cost problem.

Furthermore, the following techniques have been proposed.

There is disclosed a technique for manufacturing an aluminum alloy material, in which aluminum alloy powder containing 0.5 mass % to 5 mass % of boron is produced, a compact is formed of the aluminum alloy powder, and the compact is melted and casted into the aluminum alloy material (see PTL 1). Use of this technique definitely leads to uniform distribution of boron since the powder includes small particles.

In addition, there is disclosed an aluminum-based composite material including a ceramic frame containing a matrix of aluminum or aluminum alloy and a neutron absorbing material such as a boron compound, and a technique for manufacturing the aluminum-based composite material (see PTL 2). The ceramic frame disclosed in PTL 2 is configured as a porous preform produced in such a manner that a slurry is prepared by mixing whisker or short fiber of aluminum borate as ceramics, boron compound particles, and the like, the slurry is dehydrated and pressurized, and the pressurized slurry is sintered into the porous preform. The aluminum-based composite material is manufactured by highly impregnating the ceramic frame formed as the porous preform with molten aluminum or molten aluminum alloy, and casting and solidifying such molten metal into a matrix form.

CITATION LIST

Patent Literature

PTL 1: Japanese Patent No. 3207840.

PTL 2: Japanese Unexamined Patent Application Publication No. 2003-121590.

SUMMARY OF INVENTION

Technical Problem

However, the techniques disclosed in PTL 1 and PTL 2 also have the following problems.

Specifically, in the technique described in PTL 1, boron is definitely uniformly distributed in the powder due to the small powder particles. However, since the compact formed of the powder is produced through melting and casting of the powder, boron is also non-uniformly distributed in the compact due to aggregation/coarsening or sedimentation/surfacing of boron compound particles, and therefore boron segregation occurs in the material, leading to a possibility of insufficient neutron absorbing power.

In the technique disclosed in PTL 2, although it is described that boron or a boron compound such as boron nitride and boron oxide may be used as the neutron absorbing material, boron carbide ($B_4C$) is industrially recommended in consideration that the boron carbide has a high content of boron having excellent neutron absorbing power, and is stable even at high temperature. However, $B_4C$ is expensively used. Although it is further described that nonpressurized casting may be used as a method of impregnating the ceramic frame configured as the porous preform with aluminum, the molten aluminum insufficiently penetrates into each space between the boron compound particles contained by the ceramic frame, leading to formation of defects such as voids in the compound after casting. Hence, a high-pressure casting process must be actually used in order to produce a useful compound after casting. In order to manufacture a large aluminum-based composite material such as a cask or a basket used in the cask by the high-pressure casting process, however, a large-scale machine such as a large high-pressure press is disadvantageously required for uniform penetration of molten aluminum into each space between boron compound particles.

An object of the invention is to provide a method for manufacturing a boron-containing aluminum plate material, which secures high content of boron having the neutron absorbing power, and allows uniform boron distribution in a plate plane to be achieved at low cost while inexpensive natural-boron-containing alloy particles (hereinafter, simply referred to as "boron-containing alloy particles") are used.

Solution to Problem

To achieve the object, according to claim 1 of the invention, there is provided a method for manufacturing a boron-containing aluminum plate material, the method being characterized by having:

a spreading step of spreading boron-containing alloy particles containing borate particles having a boron content of 5 mass % or more in a layer shape over a bottom plate of aluminum or aluminum alloy placed in a container;

a preheating step of mounting a tundish for control of pouring amount on a top of the container after the spreading step, and preheating the container and the tundish together at 300° C. to 500° C.;

a casting step of enveloped-casting the layer of the boron-containing alloy particles in the container preheated in the preheating step with molten aluminum or molten aluminum alloy (hereinafter, referred to as "molten Al") by pouring the molten Al at 580° C. to 900° C. into the tundish preheated in the preheating step to fabricate an enveloped-cast plate with a predetermined thickness; and a cutting step of cutting off shrinkage cavities formed in a feeder section in an upper part of the enveloped-cast plate fabricated in the casting step.

According to claim 2 of the invention, the method according to claim 1 is characterized in that the borate particles include at least one selected from the group consisting of Al—B alloy, Ca—B alloy, Si—B alloy, Fe—B alloy, MnB alloy, and Mo—B alloy.

According to claim 3 of the invention, the method according to claim 2 is characterized in that the Al—B alloy is at least one of $AlB_{12}$ and $AlB_2$.

According to claim 4 of the invention, the method according to claim 1 is characterized in that the borate particles include first borate particles having a boron content of 60 mass % or more and second borate particles having a boron content of 5 mass % to less than 60 mass %.

According to claim 5 of the invention, the method according to claim 4 is characterized in that the borate particles include first borate particles including at least one selected from the group consisting of $AlB_{12}$, $CaB_6$, and $SiB_6$, second borate particles including at least one selected from the group consisting of FeB, $MnB_2$, $Fe_2B$, and $AlB_2$, and inevitable impurity particles.

According to claim 6 of the invention, the method according to claim 4 or 5 is characterized in that proportion of the first borate particles in the borate particles is 50 mass % or more.

According to claim 7 of the invention, the method according to any one of claims 1 to 5 is characterized in that particle diameter of the boron-containing alloy particles is 15 mm or less (not including zero).

According to claim 8 of the invention, the method according to any one of claims 1 to 5 is characterized in that the molten aluminum alloy is casting aluminum alloy including at least one selected from the group consisting of Al—Si alloy, Al—Cu alloy, and Al—Mg alloy.

According to claim 9 of the invention, the method according to any one of claims 1 to 5 is characterized in that total thickness of the enveloped-cast plate after the cutting step (hereinafter, referred to as "total enveloped-cast plate thickness") is 5 mm to 50 mm, thickness of the bottom plate is ⅕ to ⅓ of the total enveloped-cast plate thickness, and thickness of the layer of the boron-containing alloy particle is ⅓ to ⅗ of the total enveloped-cast plate thickness.

According to claim 10 of the invention, the method according to any one of claims 1 to 5 is characterized by further having a plate thickness adjusting step for adjusting plate thickness by facing or forging after the cutting step.

According to claim 11 of the invention, the method according to any one of claims 1 to 5 is characterized by further having a rolling step for producing an enveloped-cast plate having a further small thickness after the cutting step.

According to claim 12 of the invention, the method according to any one of claims 1 to 5 is characterized by further having a rolling step for producing a die material having a predetermined shape after the cutting step.

According to claim 13 of the invention, the method according to any one of claims 1 to 5 is characterized by further having a pressing step for producing a forging material having a predetermined shape after the cutting step.

Advantageous Effects of Invention

As described above, the method for manufacturing a boron-containing aluminum plate material according to the invention is characterized by having a spreading step of spreading boron-containing alloy particles containing borate particles having a boron content of 5 mass % or more in a layer shape over a bottom plate of aluminum or aluminum alloy placed in a container, a preheating step of mounting a tundish for control of pouring amount on a top of the container after the spreading step, and preheating both of the container and the tundish at 300° C. to 500° C., a casting step of enveloped-casting the layer of the boron-containing alloy particles in the container preheated in the preheating step with molten Al by pouring the molten Al at 580 to 900° C. into the tundish preheated in the preheating step to fabricate an enveloped-cast plate with a predetermined thickness, and a cutting step of cutting off shrinkage cavities formed in a feeder section in an upper part of the enveloped-cast plate fabricated in the casting step.

Consequently, the method secures high content of boron having the neutron absorbing power, and allows uniform boron distribution in a plate plane to be achieved at low cost while inexpensive boron-containing alloy particles are used.

BRIEF DESCRIPTION OF DRAWINGS

FIG. 1 is a schematic diagram for explaining, in a time series manner, a method of manufacturing a boron-containing aluminum plate material according to one embodiment of the invention.

DESCRIPTION OF EMBODIMENTS

Hereinafter, the invention is described in detail with example embodiments.

(Configuration of Method of Manufacturing Boron-Containing Aluminum Plate Material According to the Invention)

The method of manufacturing a boron-containing aluminum plate material according to the invention is characterized by having a spreading step of spreading boron-containing alloy particles containing borate particles having a boron content of 5 mass % or more in a layer shape over a bottom plate of aluminum or aluminum alloy placed in a container, a preheating step of mounting a tundish for control of pouring amount on a top of the container after the spreading step, and preheating the container and the tundish together at 300° C. to 500° C., a casting step of enveloped-casting the layer of the boron-containing alloy particles in the container preheated in the preheating step with molten Al by pouring the molten Al at 580° C. to 900° C. into the tundish preheated in the preheating step to fabricate an enveloped-cast plate with a predetermined thickness, and a cutting step of cutting off shrinkage cavities formed in a feeder section in an upper part of the enveloped-cast plate fabricated in the casting step.

According to such a configuration, the invention secures high content of boron having the neutron absorbing power, and allows uniform boron distribution to be achieved at low cost while inexpensive boron-containing alloy particles are used.

The details leading to such a configuration are now described.

The inventers have made earnest study on how to secure high content of boron having the neutron absorbing power, and achieve uniform boron distribution in a plate plane at low cost while inexpensive boron-containing alloy particles are used.

As a result, the inventors have found that the object can be accomplished through a method having the spreading step, the preheating step, the casting step, and the cutting step (in detail, see FIG. 1 described later).

The method for manufacturing a boron-containing aluminum plate material according to the invention is now described with reference to the drawing.

FIG. 1 is a schematic diagram for explaining, in a time series manner, a process of a manufacturing method of a boron-containing aluminum plate material according to one embodiment of the invention, where (a) is a view illustrating a spreading step of spreading boron-containing alloy particles 3, which include at least one selected from the group consisting of Al—B alloy, Ca—B alloy, Si—B alloy, Fe—B alloy, Mn—B alloy, and Mo—B alloy as a metal compound containing 5 mass % or more boron, in a layer shape over a bottom plate 2 of aluminum or aluminum alloy placed in a container 1, (b) includes views illustrating a preheating step of placing the container 1 after the spreading step illustrated in (a) in an electric furnace 4 (a heater 5 is provided on each side face of the electric furnace 4), mounting a tundish 6 for control of pouring amount on a top of the container 1, covering the container 1 by a lid 8 with a door 7, and preheating the container 1 and the tundish 6 together at 300° C. to 500° C., (c) is a view illustrating a casting step of enveloped-casting the layer of the boron-containing alloy particles 3 in the container 1 preheated in the preheating step with molten Al 10 by pouring the molten Al 10 at 580° C. to 900° C. from a ladle 9 into the tundish 6 preheated in the preheating step to fabricate an enveloped-cast plate ("a plate having a shape illustrated in an upper view of FIG. 1(*d*) extracted from the container 1 after casting and solidification (cooling)" described in detail later) 14 with a predetermined thickness, and (d) includes views illustrating a cutting step of cutting off shrinkage cavities 13 formed in a feeder section 12 in an upper part of the enveloped-cast plate 14 fabricated in the casting step illustrated in (c).

In FIG. 1(*a*), alloy particles containing natural boron that is not subjected to enrichment activity are used as the boron-containing alloy particles 3. The natural boron therefore contains B-10 in a natural abundance ratio of about 20%. In consideration that it is intended to secure a concentration of B-10 equal to or higher than that of B-10 contained in a boron-containing aluminum plate material produced by a traditional manufacturing method, the boron-containing alloy particles 3 must contain borate particles having the neutron absorbing power and having a boron content of 5 mass % or more.

Specifically, the borate particles preferably include at least one selected from the group consisting of Al—B alloy, Ca—B alloy, Si—B alloy, Fe—B alloy, Mn—B alloy, and Mo—B alloy. The Al—B alloy is at least one of $AlB_{12}$ and $AlB_2$.

In a possible configuration, the borate particles include first borate particles having a high B-10 content (i.e., having a boron content of 60 mass % or more), and second borate particles having a lower B-10 content than that of the first borate particles (i.e., having a boron content of 5 mass % to less than 60 mass %).

Specifically, particles including at least one selected from the group consisting of $AlB_{12}$, $CaB_6$, and $SiB_6$ may be used as the first borate particles. In addition, particles including at least one selected from the group consisting of FeB, $MnB_2$, $Fe_2B$, and $AlB_2$ may be used as the second borate particles. While various inevitable impurity particles are formed depending on selection of each of the first and second borate particles, the amount of the inevitable impurity particles is preferably controlled to be 10 mass % or less. Examples of the inevitable impurity particles include particles of composite borate such as $Mn_2AlB_2$, particles of oxide such as $Al_2O_3$, $MnO_2$, FeO, $B_2O_3$, CaO, and $SiO_2$, and the like.

A small amount of $B_4C$ particles may be contained as the first borate particles to the extent that wettability to the aluminum alloy to be poured as a boron-containing aluminum material is not adversely affected.

Use of the above-described configuration of the boron-containing alloy particles 3 increases the B-10 content of the boron-containing aluminum material mainly due to the first borate particles and subsidiarily due to the second borate particles. Use of the above-described configuration provides the neutron absorbing power of the boron-containing aluminum material mainly due to the first borate particles and subsidiarily due to the second borate particles. From the viewpoint of improving the neutron absorbing power of the boron-containing aluminum material, proportion of the first borate particles in the boron-containing alloy particles 3 is preferably 50 mass % or more.

Since an appropriate combination of the first borate particles and the second borate particles can be used as the boron-containing alloy particles 3, a degree of the neutron absorbing power can be widely adjusted.

Particles of each of FeB or $Fe_2B$ as the Fe—B alloy, $MnB_2$ as the Mn—B alloy, the Mo—B alloy, $AlB_{12}$ or $AlB_2$ as the Al—B alloy, $CaB_6$ as the Ca—B alloy, and SiBe as the Si—B alloy, the particles being corresponding to the borate particles contained by the boron-containing alloy particles 3, are desirable in having a higher melting point than the aluminum alloy to be poured (the molten Al 10 illustrated in FIG. 1(*c*) described in detail later), and in preventing the boron-containing alloy particles 3 from being melted during casting. Each of such boron-containing alloys may be not only binary alloy but also ternary or higher alloy. The lower limit of boron concentration in each alloy is 5 mass % B, which is necessary for securing a concentration equal to or higher than the concentration of B-10 given by a traditional process. The upper limit of the boron concentration is 70 mass % B in consideration of actually available boron-containing alloy. The boron-containing alloy particles 3 are preferred in that they have excellent wettability with the molten Al 10 so that the molten Al 10 easily penetrates into each space between the boron-containing alloy particles 3. The boron-containing alloy has been offered commercially for manufacturing of alloy steel, and is preferably available at low cost compared with boron carbide ($B_4C$).

A usable particle diameter of the boron-containing alloy particles 3 is 15 mm or less (not including zero).

The particle diameter is measured by a laser diffraction scattering method. In the case of the boron-containing alloy particles 3 having a particle diameter of less than 5 mm (not including zero), the molten Al 10 is less likely to penetrate into each space between the boron-containing alloy particles 3, and the boron-containing alloy particles 3 are easily stirred by casting flow. It is therefore more preferred that the boron-containing alloy particles 3 are formed into a highly-filled plate-like preform with a binder or by sintering so as to be formed as a uniform layer of the boron-containing alloy particles 3. The boron-containing alloy particles 3 having a particle diameter of 5 mm to 15 mm are most preferred since even if such boron-containing alloy particles 3 are simply disposed in a layer shape, the molten Al 10 easily penetrate into a space between the boron-containing alloy particles 3, and 95% or more of spaces between the boron-containing alloy particles 3 can be filled with the molten Al 10. In the case of using the boron-containing alloy particles 3 having a particle diameter of more than 15 mm, the enveloped-cast plate 15 (illustrated in a lower view of FIG. 1(*d*) described in detail later) after cutting off the shrinkage cavities 13 has an extremely large thickness, and is therefore unsuitable as a material for a cask or a canister.

In FIG. 1(*b*), the reason for using the tundish 6 is to allow the molten Al 10 to be evenly poured to the boron-containing alloy particles 3 spread in a layer shape on the bottom plate 2. This eliminates non-uniformity caused by casting. The container 1 and the tundish 6 are preferably preheated together at 300° C. to 500° C. This is because the molten Al 10 is solidified immediately after being poured at a preheating temperature of lower than 300° C., so that the molten Al 10 cannot sufficiently penetrate into each space between the boron-containing alloy particles 3. In addition, although the molten Al 10 can sufficiently penetrate into each space between the boron-containing alloy particles 3 at a preheating temperature of 300° C. or higher, a preheating temperature of higher than 500° C. leads to degradation in operability during fabrication of a large plate material.

In FIG. 1(*c*), the molten Al 10 preferably has a temperature of 580° C. to 900° C. This is because since Al—Si alloy has a lowest melting point of 580° C., the molten Al 10 is solidified immediately after being poured at lower than 580° C., so that the molten Al 10 may not penetrate into each space between the boron-containing alloy particles 3. Although the molten Al 10 can penetrate into the space between the boron-containing alloy particles 3 at 580° C. or higher, temperature of the molten Al 10 is actually preferably 900° C. or lower in consideration that normal melting equipment for aluminum alloy casting is used. A casting aluminum alloy including at least one selected from Al—Si alloy, Al—Cu alloy, and Al—Mg alloy can be used as the molten aluminum alloy being the molten Al 10. Such a casting aluminum alloy is preferred for casting of a thin plate due to its excellent penetrability into the space between the boron-containing alloy particles 3. In particular, Al—Si alloy is more preferred for casting of a thin plate since molten Al—Si alloy has excellent flow property, or fluidity.

During solidification of the molten Al 10, the shrinkage cavities 13 (illustrated in the upper view of FIG. 1(*d*)) are necessarily formed due to solidification shrinkage. The plate material is therefore manufactured in such a manner that the layer of the boron-containing alloy particles 3 is enveloped-casted with the molten Al 10 by pouring (feeding) the molten Al 10 in the amount corresponding to a thickness about 10 mm to 15 mm larger than total thickness (total enveloped-cast plate thickness) of the enveloped-cast plate 15 (illustrated in the lower view of FIG. 1(*d*)) after cutting off the shrinkage cavities 13, so that the enveloped-cast plate 14 having a predetermined thickness as illustrated in the upper view of FIG. 1(*d*) is produced after the casting step.

In FIG. 1(*d*), the total thickness of the enveloped-cast plate 15 after cutting off the shrinkage cavities 13 is desirably 5 mm to 50 mm, the shrinkage cavities 13 being formed in the feeder section 12 in an upper part of the enveloped-cast plate 14 fabricated in the casting step illustrated in FIG. 1(*c*). This is because material strength is insufficient at a plate thickness of less than 5 mm, and a plate thickness of more than 50 mm is too large in design of the cask or canister.

The thickness of the layer of the boron-containing alloy particles 3 is desirably ⅓ to ⅗ of the total thickness of the enveloped-cast plate 15. This is because the thickness of less than ⅓ of the total thickness results in low total boron concentration of the enveloped-cast plate 15, and thus prevents the boron concentration of 5 mass % or more from being maintained. In addition, the thickness of more than ⅗ thereof results in a thin aluminum alloy portion (a portion 11 of the solidified molten Al 10) enveloping the layer of the boron-containing alloy particles 3, leading to insufficient material strength of the enveloped-cast plate 15.

The thickness of the bottom plate 2 is desirably ⅕ to ⅓ of the total thickness of enveloped-cast plate 15. This is because the thickness of less than ⅕ of the total thickness results in insufficient material strength of the enveloped-cast plate 15. In addition, the thickness of more than ⅓ thereof results in small thickness of the layer of the boron-containing alloy particles 3 relative to the total thickness of the enveloped-cast plate 15, leading to low total boron concentration of the enveloped-cast plate 15. Since the bottom plate 2 having a flat and smooth surface can be used, the total thickness of the enveloped-cast plate 14 after solidification of the molten Al 10 can be easily controlled.

A plate thickness adjusting step for adjusting plate thickness by facing is provided after the cutting step for cutting off the shrinkage cavities 13 illustrated in FIG. 1(*d*), thereby a final product with a predetermined thickness can be fabricated while irregularities remaining on a surface of the enveloped-cast plate 15 are removed. A plate thickness adjusting step for adjusting plate thickness by forging is provided after the cutting step for cutting off the shrinkage cavities 13 illustrated in FIG. 1(*d*), thereby a large final product can be manufactured without large-scale equipment such as a large press.

A rolling step is provided after the cutting step for cutting off the shrinkage cavities 13 illustrated in FIG. 1(*d*), thereby an enveloped-cast plate having a further small thickness or a die material having a predetermined shape (for example, a die material such as an angle having a simple shape) can be fabricated.

A pressing step is provided after the cutting step for cutting off the shrinkage cavities 13 illustrated in FIG. 1(*d*), thereby a forging material having a predetermined shape can be produced.

First Embodiment

Detailed description is now made on a first embodiment to which the method of manufacturing the boron-containing aluminum plate material according to the invention as illustrated in FIG. 1 was applied.

Manufacturing Conditions

Container 1: graphite container 100 mm in depth, 200 mm in width, and 70 mm in height (inside dimension each).

Tundish 6: 120 mm in depth, 220 mm in width, and 70 mm in height.

Bottom plate 2: pure aluminum plate 3 mm in thickness.

Boron-containing alloy particles 3: Fe-20 mass % B alloy 1 mm in particle diameter.

Layer of boron-containing alloy particles 3: boron-containing alloy particles 3 are preformed into a layer shape with an inorganic binder so as to be formed as a plate 4 mm in thickness, and the plate is placed on the bottom plate 2.

Particle filling rate of layer of boron-containing alloy particles 3: 65%.

Molten Al 10: molten Al-13 mass % Si alloy at 750° C.

Preheating temperature of container 1 and tundish 6: 500° C.

Cutting of shrinkage cavities 13: facing.

The enveloped-cast plate 15 prepared according to the above-described manufacturing conditions had a total thickness of 10 mm and a total boron concentration of 5.2 mass %.

Second Embodiment

As with the first embodiment, the method of manufacturing the boron-containing aluminum plate material according to the invention as illustrated in FIG. 1 was applied to a second embodiment. In the second embodiment, only manufacturing conditions different from those described in the first embodiment are described in detail.

Manufacturing Conditions

Bottom plate 2: pure aluminum plate 4 mm in thickness.

Boron-containing alloy particles 3: Fe-20 mass % B alloy particles 4 mm in diameter.

Layer of boron-containing alloy particles 3: boron-containing alloy particles 3 are preformed into a layer shape with an inorganic binder so as to be formed as a plate 10 mm in thickness, and the plate is placed on the bottom plate 2.

Particle filling rate of layer of boron-containing alloy particles 3: 55%.

The enveloped-cast plate 15 prepared according to the above-described manufacturing conditions had a total thickness of 19 mm and a total boron concentration of 5.8 mass %.

Third Embodiment

As with the first embodiment, the method of manufacturing the boron-containing aluminum plate material according to the invention as illustrated in FIG. 1 was applied to a third embodiment. In the third embodiment, only manufacturing conditions different from those described in the first embodiment are described in detail.

Manufacturing Conditions

Bottom plate 2: pure aluminum plate 4 mm in thickness.

Boron-containing alloy particles 3: Fe-20 mass % B alloy particles 9 mm in diameter.

Layer of boron-containing alloy particles 3: boron-containing alloy particles 3 corresponding to one layer are spread over the bottom plate 2.

Particle filling rate of layer of boron-containing alloy particles 3: 50%.

The enveloped-cast plate 15 prepared according to the above-described manufacturing conditions had a total thickness of 17 mm and a total boron concentration of 5.3 mass %.

Fourth Embodiment

As with the first embodiment, the method of manufacturing the boron-containing aluminum plate material according to the invention as illustrated in FIG. 1 was applied to a fourth embodiment. In the fourth embodiment, only manufacturing conditions different from those described in the first embodiment are described in detail.

Manufacturing Conditions

Boron-containing alloy particles 3: boron-containing alloy particles 1 mm in diameter (see the following Table 1).

Layer of boron-containing alloy particles 3: boron-containing alloy particles 3 are preformed into a layer shape with an inorganic binder so as to be formed as a plate 4 mm in thickness, and the plate is placed on the bottom plate 2.

Particle filling rate of layer of boron-containing alloy particles 3: 65%.

The enveloped-cast plate 15 prepared according to the above-described manufacturing conditions had a total thickness of 10 mm, and a total boron concentration of 10 mass % since the boron-containing alloy particles 3 shown in Table 1 had a total boron concentration of 60 mass %.

TABLE 1

| Boron-containing alloy particles 3 | | | | |
|---|---|---|---|---|
| First borate particles | | Second borate particles | | Inevitable impurity |
| $AlB_{12}$ | $CaB_6$ | $MnB_2$ | $AlB_2$ | particles |
| 56.7 | 3.4 | 27.8 | 7.4 | Remainder |

by mass %

Although the invention has been described in detail with reference to specific embodiments, it should be understood by those skilled in the art that various alterations and modifications thereof may be made without departing from the spirit and the scope of the invention.

The present application is based on Japanese patent application (JP-2012-118567) filed on May 24, 2012 and Japanese patent application (JP-2013-010054) filed on Jan. 23, 2013, the content of each of which is hereby incorporated by reference.

INDUSTRIAL APPLICABILITY

According to the invention, a boron-containing aluminum plate material having a high boron content, which is used for an interim storage vessel of spent fuel in a nuclear power plant, can be manufactured at low cost.

LIST OF REFERENCE SIGNS

1 container
2 bottom plate
3 boron-containing alloy particles
4 electric furnace
5 heater
6 tundish
7 door
8 lid
9 ladle
10 molten Al
11 portion of solidified molten Al 10
12 feeder section
13 shrinkage cavities
14 enveloped-cast plate extracted from container 1 after casting and solidification (cooling)
15 enveloped-cast plate after cutting off shrinkage cavities 13

The invention claimed is:

1. A method for manufacturing a boron-containing aluminum plate material, the method comprising:

spreading boron-containing alloy particles comprising borate particles having a boron content of 5 mass % or more in a layer shape over a bottom plate of aluminum or aluminum alloy placed in a container;

after the spreading, mounting a tundish on a top of the container and preheating the container and the tundish together at 300° C. to 500° C.;

enveloped-casting the layer of the boron-containing alloy particles in the preheated container with molten aluminum or molten aluminum alloy by pouring the molten aluminum or molten aluminum alloy at 580° C. to 900° C. into the preheated tundish to fabricate an enveloped-cast plate with a predetermined thickness; and cutting off shrinkage cavities formed in a feeder section in an upper part of the enveloped-cast plate.

2. The method for manufacturing the boron-containing aluminum plate material according to claim 1, wherein the boron-containing alloy particles comprise at least one selected from the group consisting of Al—B alloy, Ca—B alloy, Si—B alloy, Fe—B alloy, Mn—B alloy, and Mo—B alloy.

3. The method for manufacturing the boron-containing aluminum plate material according to claim 2, wherein the boron-containing alloy particles comprise the Al—B alloy and the Al—B alloy is at least one of $AlB_{12}$ and $AlB_2$.

4. The method for manufacturing the boron-containing aluminum plate material according to claim 1, wherein the boron-containing alloy particles comprise first borate particles having a boron content of 60 mass % or more and second borate particles having a boron content of 5 mass % to less than 60 mass %.

5. The method for manufacturing the boron-containing aluminum plate material according to claim 4, wherein the first borate particles comprise at least one selected from the group consisting of $AlB_{12}$, $CaB_6$, and $SiB_6$, and the second borate particles comprise at least one selected from the group consisting of FeB, $MnB_2$, $Fe_2B$, and $AlB_2$.

6. The method for manufacturing the boron-containing aluminum plate material according to claim 1, wherein the boron-containing alloy particles comprise first borate particles wherein the first borate particles are present in the borate particles in an amount of 50 mass % or more.

7. The method for manufacturing the boron-containing aluminum plate material according to claim 1, wherein the boron-containing alloy particles have a particle diameter of 15 mm or less.

8. The method for manufacturing the boron-containing aluminum plate material according to claim 1, wherein the molten aluminum alloy is a casting aluminum alloy comprising at least one selected from the group consisting of Al—Si alloy, Al—Cu alloy, and Al—Mg alloy.

9. The method for manufacturing the boron-containing aluminum plate material according to claim 1, wherein the enveloped-cast plate has a total thickness after the cutting of 5 mm to 50 mm, the bottom plate has a thickness of ⅕ to ⅓ of the total thickness of the enveloped-cast plate, and the layer of the boron-containing alloy particles is ⅓ to ⅗ of the total thickness of the enveloped-cast plate.

10. The method for manufacturing the boron-containing aluminum plate material according to claim 1, further comprising adjusting the enveloped-cast plate thickness by facing or forging after the cutting.

11. The method for manufacturing the boron-containing aluminum plate material according to claim 1, further comprising rolling the enveloped-cast plate to reduce the enveloped-cast plate thickness after the cutting.

12. The method for manufacturing the boron-containing aluminum plate material according to claim 1, further comprising rolling the enveloped-cast plate with a die material having a predetermined shape after the cutting.

13. The method for manufacturing the boron-containing aluminum plate material according to claim 1, further comprising pressing the enveloped-cast plate with a forging material having a predetermined shape after the cutting.

* * * * *